United States Patent [19]

Butterworth

[11] Patent Number: 4,544,810

[45] Date of Patent: Oct. 1, 1985

[54] INTERLOCKING PUSHBUTTON SELECTOR SWITCH

[75] Inventor: Edmund M. Butterworth, Brown Deer, Wis.

[73] Assignee: Eaton Corporation, Cleveland, Ohio

[21] Appl. No.: 569,126

[22] Filed: Jan. 9, 1984

[51] Int. Cl.[4] ..... H01H 9/20

[52] U.S. Cl. ..... 200/5 B; 200/5 D; 200/5 E; 200/50 C; 200/328

[58] Field of Search ..... 200/5 B, 5 C, 5 D, 5 E, 200/5 EA, 5 EB, 310, 311, 314, 328; 74/483 PB

[56] References Cited

U.S. PATENT DOCUMENTS

| | | | |
|---|---|---|---|
| 1,053,245 | 2/1913 | Turner et al. | 200/5 D |
| 2,295,517 | 9/1942 | Meuer | 200/5 E |
| 2,622,138 | 12/1952 | Cooper | 200/5 E X |
| 3,207,859 | 9/1965 | Tancred | 200/5 EA |
| 3,303,295 | 2/1967 | Davis | 200/5 B |
| 3,312,806 | 4/1967 | Waldorf et al. | 200/328 X |
| 3,478,179 | 11/1969 | Hanson et al. | 200/5 E |
| 3,560,677 | 2/1971 | Kolb et al. | 200/50 C |
| 4,143,252 | 3/1979 | Moore | 200/5 B |

*Primary Examiner*—J. R. Scott

*Attorney, Agent, or Firm*—C. H. Grace; W. A. Autio

[57] ABSTRACT

A switch having a pair of spring-biased switch pushbuttons (6, 10) for operating respective switches (8, 12). A slidable interlocking bar (24) allows depression of only one pushbutton at a time. The switches may be either double-throw (18, 20) or single-throw (22). The switch housing (2, 4) will accept a selected one of two interchangeable switch accessories including latching and auxiliary contact means having a pair of latching members (26, 28) pivotally mounted in the housing, a spring-biased release pushbutton (30) slidably mounted in the housing, and actuator (32) pivotally mounted on the release pushbutton for actuating either latching member, and auxiliary contacts (38, 40) for actuation by the release pushbutton, or a transformer (42) operated pilot light (44).

8 Claims, 5 Drawing Figures

INTERLOCKING PUSHBUTTON SELECTOR SWITCH

BACKGROUND OF THE INVENTION

Interlocking pushbutton selector switches have been known heretofore. For example, J. R. Hanson and A. F. Kolb U.S. Pat. No. 3,478,179, dated Nov. 11, 1969, shows a multiposition selector switch for an enclosed electrical control station having first and second pushbuttons for closing either the right-hand or the left-hand contacts, respectively, and a center pushbutton for releasing the depressed left-hand or right-hand pushbutton so as to reopen the closed contacts. When either the left-hand or right-hand pushbutton is depressed, a toggle lever mechanism is and closes the corresponding contacts and also actuates an interlocking bar which prevents simultaneous of the other contacts closing pushbutton. When the center, release pushbutton is depressed, the actuated toggle lever mechanism is restored whereafter either the left-hand or the right-hand pushbutton can again be depressed.

While multiposition selector switches of the aforementioned prior art type have been useful for their intended purposes, this invention relates to improvements thereover.

SUMMARY OF THE INVENTION

An object of the invention is to provide an improved interlocking pushbutton selector switch.

A more specific object of the invention is to provide an interlocking selector switch having a pair of spring-biased pushbuttons for closing respective contacts with improved means effective upon depression of one of spring pushbuttons for automatically latching such pushbutton in its depressed position.

Another specific object of the invention is to provide an interlocking pushbutton selector switch having a pair of spring-biased pushbuttons for closing respective contacts with improved interlocking means effective upon depression of one of the pushbuttons for preventing concurrent depression of the other pushbutton.

Another specific object of the invention is to provide an interlocking pushbutton selector switch having a pair of spring-biased pushbuttons for closing respective contacts with improved latching means automatically responsive to depression of one of the spring-biased pushbuttons for latching the same in its depressed position and a release button effective upon momentary depression thereof for releasing the latch thereby to allow automatic restoration of the depressed spring-biased pushbutton and consequent reopening of its contacts.

Another specific object of the invention is to provide an interlocking pushbutton selector switch having a pair of spring-biased pushbuttons for closing respective contacts with improved latching means effective upon depression of one of the pushbuttons for automatically latching the same in its depressed position and a spring-biased release button for automatically actuating such latching means.

Another specific object of the invention is to provide an interlocking pushbutton selector switch of the aforementioned type with an auxiliary contact that is actuated by the release pushbutton concurrently with actuation of said latching means.

Another specific object of the invention is to provide an interlocking pushbutton selector switch having a pair of spring biased pushbuttons for actuating respective contacts and an interlocking bar for preventing concurrent depression of the two pushbuttons with improved latching means for latching the depressed one of the pushbuttons in its depressed position and release pushbutton means for releasing said latching means and auxiliary contact means for actuation by said release pushbutton as well as a transformer operated indicator light with the selector switch being constructed and arranged so that the transformer operated indicator light can be substituted for the latching means, release pushbutton and auxiliary contacts.

Another specific object of the invention is to provide an interlocking pushbutton selector switch of the aforementioned type that, except for the metal parts such as the contacts and the biasing means, can be constructed entirely of plastic molded parts.

Other objects and advantages of the invention will hereinafter appear.

These and other objects and advantages of the invention are accomplished by providing a plural pushbutton electric switch of the interlocking type comprising a switch housing, contacts mounted in the housing, a pair of spring-biased pushbuttons for operating respective switch contacts in the housing and interlock member mounted in the housing between the pushbuttons, means operable when one of the pushbuttons is depressed in the contact operating position for rendering said interlock member effective to prevent simultaneous depression of the other pushbutton, characterized by latching means comprising a pair of latching members movably mounted in the housing, one for each of the pushbuttons, a spring-biased release member mounted in the housing between the pushbuttons and actuating member between the latching members movably mounted on the release member and normally engaging the latching members to bias the same against the respective pushbuttons and to maintain the release member in depressed position, and means responsive to depression of one of the pushbuttons into its contact operating position for causing the associated latching member to latch the same in such contact operating position under the control of the actuating member as the release member restores to undepressed position, requiring depression of the release member to allow restoration of the latched pushbutton.

DESCRIPTION OF THE PREFERRED EMBODIMENT

Figure 2:
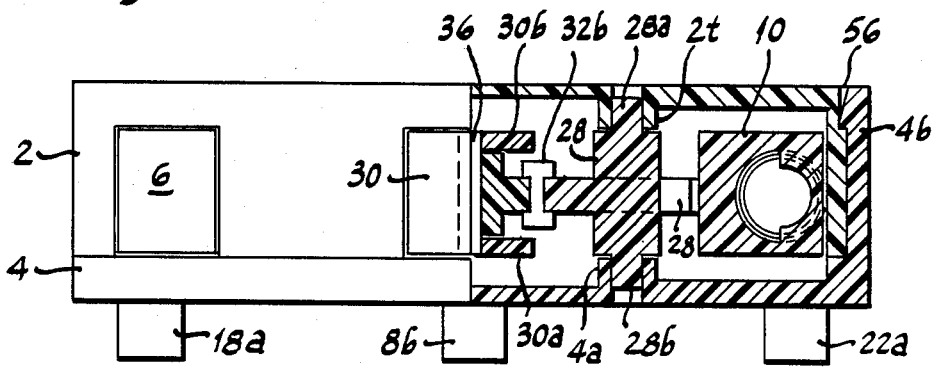
FIG. 2 is a partial top view and a partial cross-sectional view taken substantially along line 2—2 of FIG. 1, showing the latching mechanism thereof.
Figure 1:
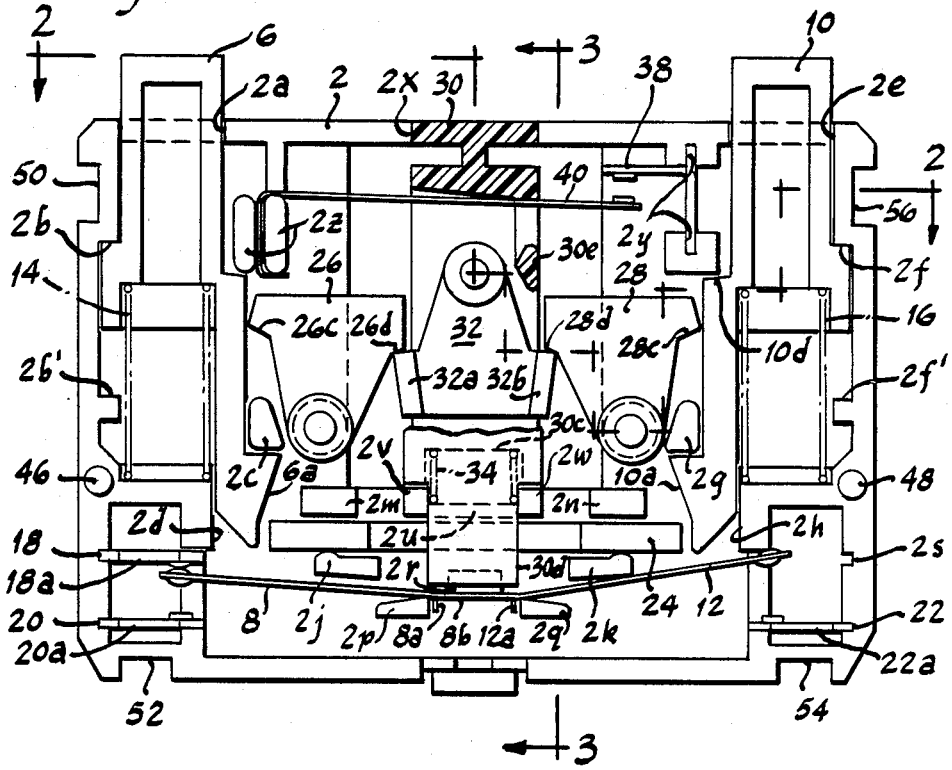
FIG. 1 is a front elevational view, with the cover removed, partially in section, of an interlocking pushbutton selector switch constructed in accordance with the invention, showing the internal mechanism thereof.
Figure 3:
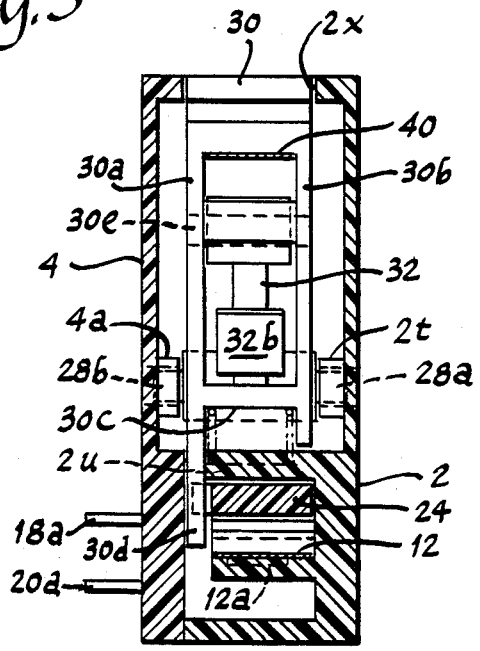
FIG. 3 is a vertical cross-sectional view taken substantially along line 3—3 of FIG. 1, showing the configuration of the release pushbutton.

Referring to FIGS. 1–3, there is shown an interlocking pushbutton selector switch in accordance with the invention having an insulating base 2 closed by a cover 4 as shown in FIGS. 2–3, the cover having been removed in FIG. 1 to show the internal mechanism thereof. This switch comprises a left spring-biased pushbutton 6 for operating left contact 8 and a right spring-biased pushbutton 10 for operating right contact 12. Pushbuttons 6 and 10 are provided with helical compression bias springs 14 and 16, respectively, for biasing the pushbuttons into their uppermost positions as shown in FIG. 1. Base 2 is provided at the left-hand side thereof with suitable guiding means for guiding pushbutton 6 in limited vertical movement, including a rectangular aperture 2*a* in the upper wall of the base, stops 2*b* and 2*c* and a vertical abutting wall 2*d*. In a similar manner base 2 is provided with means for guiding pushbutton 10 in limited vertical movement including an aperture 2*e* in the upper wall of the base, stops 2*f* and 2*g* and a vertical abutting wall 2*h*. As will be apparent, stops 2*b* and 2*c* at the left-hand portion of base 2 limit the upward extension of pushbutton 6 under the force of return spring 14. Pushbutton 6 may be depressed from its uppermost position shown in FIG. 1 against the bias of return spring 14 in order to engage movable, double-throw contact 8 and shifted from engagement with normally closed contact 18 into engagement with normally open contact 20. In a similar manner pushbutton 10 may be depressed from its uppermost position where it abuts stops 2*f* and 2*g* against the bias of return spring 16 in order to engage single-throw movable contact 12 and shifted into engagement with normally open contact 22 as shown in FIG. 4.

Pushbuttons 6 and 10 are provided with interlocking means which comprises cam surfaces 6*a* and 10*a* at the lower end portions of the respective pushbuttons and a horizontally slidable interlocking bar 24. When pushbutton 10 is depressed into its contact closed position as shown in FIG. 4, cam surface 10*a* engages the right-hand end of interlocking bar 24 and shifts it to the left so that its left-hand end abuts the lower tip of pushbutton 6 directly below cam surface 6*a*, thereby preventing concurrent depression of pushbutton 6. Base 2 is provided with suitable, integrally molded abutments 2*j* and 2*k* below the bar and abutments 2*m* and 2*n* above the bar to provide a horizontal slot therebetween for slidingly accommodating interlocking bar 24.

Movable contacts 8 and 12 are left and right end portions of a single contact spring mounted at its center between lugs integrally molded within the base. These lugs include a pair of spaced lower lugs 2*p* and 2*q* and a central upper lug 2*r*. The contact spring is forced in between the two lower lugs and the upper lugs and is provided with a pair of formed, downwardly-projecting lugs 8*a* and 12*a* that enter in between lugs 2*p* and 2*q* in the base and thus prevent lateral movement of the contact spring as more clearly shown in FIG. 4. Stationary contacts 18, 20 and 22 are provided with forwardly projecting terminals 18*a*, 20*a* and 22*a* that extend through the cover of the switch as shown in FIGS. 2 and 3 for connection to an external circuit. In a similar manner, movable contact spring 8,12 is provided at its center with a forwardly projecting terminal 8*b* that extends out through the cover 4 for connection to an external circuit. This terminal 8*b* is a common terminal which can be connected by the switch to either terminals 20*a* or 22*a*. This common terminal 8*b* can also be connected to both terminals 18*a* and 22*a* since contact 18 is a normally closed contact. Thus, the arrangement provides for a single-throw switch and a double-throw switch. Base 2 is provided with suitable slots 2*s* at the right-hand side for accommodating a normally closed contact if desired in the same manner as shown at the left-hand side.

Figure 4:
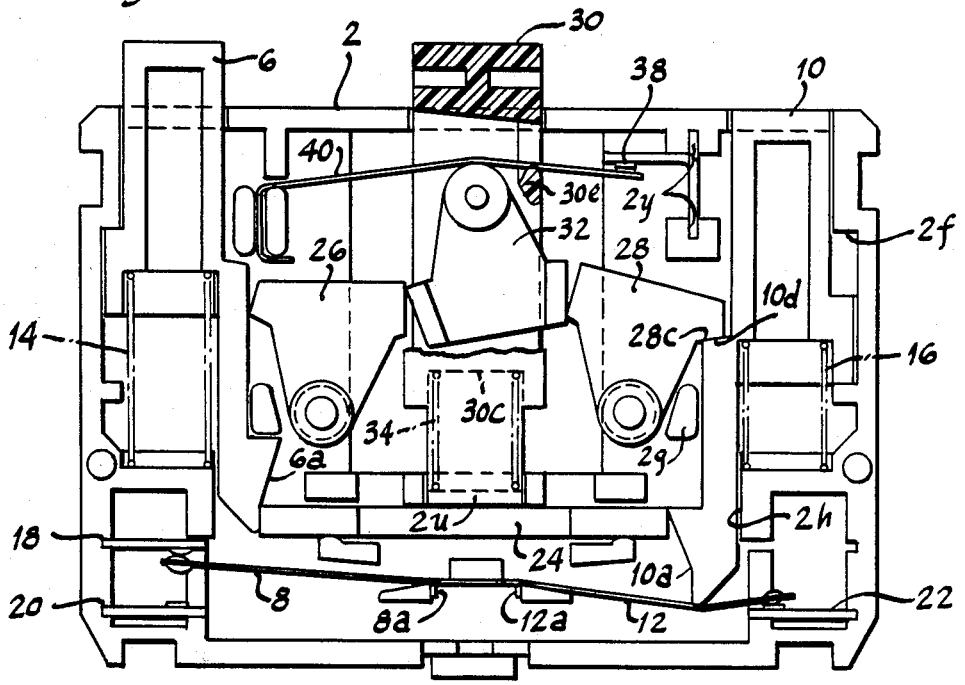
FIG. 4 is a front elevational view, with the cover removed, like FIG. 1 but with the right-hand pushbutton latched in its depressed and contact closed position.

Pushbuttons 6 and 10 are provided with pivotally-mounted latching members 26 and 28 having latching projections 26*c* and 28*c*, respectively, which serve to latch either pushbutton in its depressed position as shown in FIG. 4 under the control of a spring-biased release pushbutton 30 mounted in the base therebetween. As shown in FIG. 2 and 3, member 28 is provided with a two-ended journal 28*a*–28*b* mounting it for rotation in a pair of bearing hubs 2*t* and 4*a* integrally molded in base 2 and cover 4. Latching projection 28*c* slips over a shoulder 10*d* on pushbutton 10 when latching member 28 is depressed into contact closing position shown in FIG. 4. This allows a latch retaining member or actuating member 32 to rise up between latching members 26 and 28 to retain latching member 28 in its latching position. Latch retaining member 32 is pivotally mounted on and operated by spring-biased release pushbutton 30 which is normally in its depressed position as shown in FIG. 1 and is pushed upwardly by its bias spring 34 whenever one of the pushbuttons 6 or 10 is depressed. As shown in FIG. 3, release pushbutton 30 is divided so that it has a front wall 30*a* and a rear wall 30*b* with a space therebetween. Latch retaining member 32 is pivotally mounted between front wall 30*a* and rear wall 30*b* by a pivot pin 36 that extends through both walls of the release pushbutton and through latch retaining member 32 as shown in FIG. 2. At its lower end, pushbutton 30 is provided with an upwardly extending pocket 30*c* for retaining the upper end portion of its return bias spring 34. The lower end of return bias spring 34 abuts against a shelf 2*u* integrally molded in the base as shown in FIG. 3. Shelf 2*u* has a divided forward end portion providing a pair of guiding lugs 2*v* and 2*w* for guiding the narrowed lower end portion 30*d* of front wall 30*a* of release pushbutton 30. Thus, release pushbutton 30 is guided for vertical sliding movement between lugs 2*v*–2*w* at its lower end and by the sides of an aperture 2*x* in the upper wall of base 2.

Latch retaining member 32 has a pair of lower wing portions 32*a* and 32*b* as shown in FIG. 1 that are substantially wider and span the thickness of latch members 26 and 28, wing portion 32*b* being shown in FIG. 2. In the off position of the switch as shown in FIG. 1, these wing portions 32*a* and 32*b* are biased up against undercut portions 26*d* and 28*d* of latches 26 and 28, respectively, thereby tending to rotate latch member 26 counterclockwise and to rotate latch member 28 clockwise. These undercut portions 26*d* and 28*d* have a suitable angle so that the wing portions 32*a* and 32*b* of latch retaining member 32 will slide up therealong when either pushbutton is depressed thereby to rotate the corresponding latching member into latching position as shown in FIG. 4.

The switch is also provided with an auxiliary switch or auxiliary contacts arranged to close when either pushbutton is depressed. This auxiliary switch comprises a stationary contact 38 and a movable spring blade contact 40 mounted near the top of the switch and arranged for actuation by the release pushbutton 30.

The base 2 is provided with integrally molded means for mounting both stationary contact 38 and movable contact 40. For this purpose, the base is provided at its upper right-hand portion with a pair of slots 2*y* into which stationary contact 38 is pressed to be held rigidly therein when cover 4 is assembled onto the base. The base is provided at its upper left-hand portion with a pair of closely spaced lugs 2*z* having a narrow vertical space therebetween into which the angular mounting portion of movable contact 40 is pressed to be rigidly retained therein when the cover is assembled onto the base. Movable contact 40 extends from its mounting location through the space in release pushbutton 30 above latch retainer 32 and between front portion 30*a* and rear portion 30*b* thereof as shown in FIGS. 1 and 3. Release pushbutton 30 is provided at its right-hand side as seen in FIG. 1 with a side connecting section 30*e* integrally molded therewith connecting front portion 30*a* and rear portion 30*b* of the pushbutton and providing thereabove a window through which movable contact 40 extends. The purpose of this window, of course, is to provide upper and lower rims on the window which bear against movable contact 40 to open the same as shown in FIG. 1 when release button 30 is in its depressed position and to close contact 40 when one of the pushbuttons is depressed and release button 30 pops up to its uppermost position as shown in FIG. 4.

Figure 5:
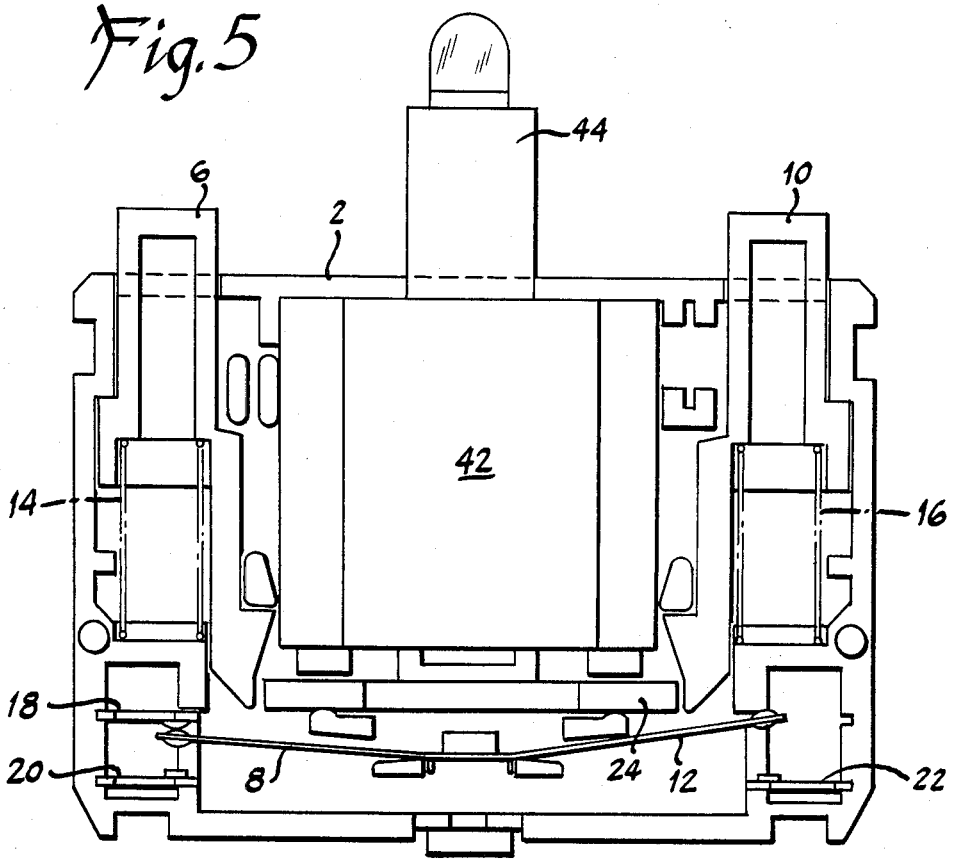
FIG. 5 is a front elevational view, with the cover removed, of the interlocking pushbutton selector switch wherein a transformer and pilot light have been substituted for the latching mechanism and auxiliary contact of the switch of FIGS. 1–4.

Referring to FIG. 5, there is shown a modification of the switch which can be made by omitting some parts of the version in FIGS. 1–4 and substituting other parts. Thus, by omitting auxiliary contacts 38 and 40, release pushbutton 30 along with latch retaining member or actuating member 32 and bias spring 34 and latches 26 and 28 space will be provided for substituting transformer 42 and indicator light 44. Suitable terminals can be provided in either the base or the cover for connecting transformer 42 and pilot lamp 44 to external circuits.

Base 2 is provided with a pair of projections 46 and 48 at its left and right sides that fit into suitable holes in the cover to position the cover onto the base. Base 2 is also provided with a plurality, such as 4, channels 50, 52, 54 and 56 distributed around its side and lower walls for receiving snap-in fingers integrally molded with the cover, one of these fingers 4*b* being shown at the right-hand portion of FIG. 2 in snap-in engagement with channel 56.

From the foregoing, it will be apparent that when pushbutton 10 is depressed its lower tip will engage movable contact 12 and move it into contact with stationary contact 22. As pushbutton 10 moves down, its cam surface 10*a* engages the right-hand end of interlock member 24 and slides it toward the left into abuttiung engagement with the lower toe of pushbutton 6 thereby preventing concurrent operation of pushbutton 6. When pushbutton 10 reaches its lower end of travel wherein it abuts stop 2f' in the base, the right-hand extension of latch member 28 slips over shoulder 10*d* of pushbutton 10 and release button 30 snaps upwardly under the force of its bias spring 34 to the position shown in FIG. 4 thereby latching pushbutton 10 in its operated depressed position. When release button 30 snapped upwardly, the upper portion of retainer member 32 mounted thereon and connecting portion 30*e* engaged the lower side of auxiliary contact spring 40 to close it into contact with stationary auxiliary contact 38 as shown in FIG. 4. The switch will now remain in this condition until release button 30 is depressed. Contacts 12 and 22 close a circuit for the switch function and auxiliary contacts 38 and 40 close a circuit for performing an auxiliary function such as electrical interlocking, indicator light energization, or the like. When release button 30 is depressed it carries latch retainer 32 downwardly with it until its wing 32*b* reaches undercut 28*d* on latch 28, thereby allowing latch 28 to be rotated in the counterclockwise direction by shoulder 10*d* of pushbutton 10 which is biased upwardly by its spring 16. This allows pushbutton 10 to restore and consequent opening of contact 12 from contact 22. If pushbutton 6 is depressed, the action is similar in that latch 26 then rotates counter-clockwise to latch pushbutton 6 in its operated position and release button 30 snaps upwardly whereby latch retainer 32 retains the pushbutton latched. When release button 30 is next depressed, pushbutton 6 is restored to its normal upward position shown in FIG. 1 as hereinbefore described in connection with pushbutton 10.

While the apparatus hereinbefore described is effectively adapted to fulfill the objects stated, it is to be understood that the invention is not intended to be confined to the particular preferred embodiment of interlocking pushbutton selector switch disclosed, inasmuch as it is susceptible of various modifications without departing from the scope of the appended claims.

I claim:

1. A plural pushbutton electric switch of the interlocking type comprising:
- a switch housing;
- contacts mounted in said housing;
- a pair of spring-biased pushbuttons for operating respective switch contacts in said housing;
- an interlock member mounted in said housing between said pushbuttons;
- means operable when one of said pushbuttons is depressed into contact operating position for rendering said interlock member effective to prevent simultaneous depression of the other pushbutton;
- and latching means comprising:
- a pair of latching members movably mounted in said housing, one for each of said pushbuttons;
- a spring-biased depressible release member mounted in said housing between said pushbuttons;
- an actuating member between said latching members movably mounted on said release member and normally engaging said latching members to bias the same against the respective pushbuttons under the spring bias of said release member and being engaged by said latching members to maintain said release member in depressed position;
- and means responsive to depression of one of said pushbuttons into said contact operating position for causing the associated latching member to latch the same in said contact operating position under the control of said spring-biased release member and actuating member as said release member restores to undepressed position, requiring depression of said release member against its spring bias to allow restoration of said latched pushbutton.

2. The plural pushbutton electric switch of the interlocking type claimed in claim 1, wherein:
- said contacts comprise auxiliary contacts mounted in said housing;
- and means on said release member for operating said auxiliary contacts in one of its positions.

3. The plural pushbutton electric switch of the interlocking type claimed in claim 2 wherein:
- said switch comprises:

a transformer and a pilot light operated thereby;

and said housing comprises means for mounting said transformer and pilot light in place of said latching members, release member, auxiliary contacts and actuating member.

4. The plural pushbutton electric switch of the interlocking type claimed in claim 1, wherein:

said interlock member comprises a substantially linear member extending between said pushbuttons;

spaced lugs in said housing for mounting said interlock member for linear movement;

and cams on the internal end portions of said pushbuttons arranged such that, when one of said pushbuttons is depressed, the cam thereon slides the interlock member against the internal tip of the other pushbutton adjacent the cam thereon to prevent concurrent depression of said other pushbutton.

5. The plural pushbutton electric switch of the interlocking type claimed in claim 1, wherein:

said means responsive to depression of one of said pushbuttons into said contact operating position for causing the associated latching member to latch the same comprises:

a cam surface on said associated latching member against which said actuating member acts under the force of said spring-biased release member to pivot said latching member into latching engagement with said one pushbutton to latch the same.

6. The plural pushbutton electric switch of the interlocking type claimed in claim 1, wherein:

said actuating member comprises means responsive to depression of said spring-biased release member for clearing said cam surface to allow pivoting of said associated latching member back to unlatching position;

and a second cam surface on said associated latching member against which said one pushbutton acts under the force of its bias to pivot said associated latching member back and thus allow restoration of said one pushbutton to its undepressed position.

7. An interlocking pushbutton selector switch comprising:

an insulating housing;

switch contacts mounted in said housing;

a pair of spring-biased switch pushbuttons slidably mounted in said housing for operating respective ones of said switch contacts;

an interlock member slidably mounted in said housing between said pushbuttons;

means on said pushbuttons effective when one of said pushbuttons is depressed into switch contact operating position for moving said interlock member into interfering relation with respect to the other pushbutton to prevent concurrent operation of said other pushbutton;

and latching means comprising:

a pair of latching members pivotally mounted in said housing, one for each of said pushbuttons;

a spring-biased release pushbutton slidably mounted in said housing between said switch pushbuttons;

a latch actuating and retaining member pivotally mounted on said release pushbutton between said latching members and normally engaging said latching members to bias the same toward latching positions and to retain said release pushbutton in depressed position;

means responsive to depression of one of said switch pushbuttons into said switch contact operating position for causing said latch actuating and retaining member to pivot the corresponding latching member into latching position with respect to said one pushbutton to retain the same under the upward force and movement of said spring-biased release pushbutton;

and means responsive to subsequent depression of said release pushbutton for allowing said spring-biased switch pushbutton to pivot said latching member back out of latching position and restore itself to undepressed position.

8. An interlocking pushbutton selector switch comprising:

an insulating housing comprising a base and a cover secured to and closing said base to provide a compartment therewithin;

contacts mounted in said housing compartment including switch contacts and an auxiliary contact;

a pair of spring-biased switch pushbuttons slidably mounted in said housing for operating respective ones of said switch contacts;

holes in the upper wall of said housing through which said pushbuttons extend for manual depression;

an interlocking member slidably mounted within said housing compartment between said pushbuttons to restrict the latter to alternate operation;

means on said pushbuttons effective when one of said pushbuttons is depressed into switch contact operating position for moving said interlocking member into engagement with the other pushbutton to prevent concurrent operation thereof;

and a selected one of two interchangeable switch accessory means including (a) latching and auxiliary contact means having a pair of latching members pivotally mounted in said housing, a spring-biased release pushbutton slidably mounted in said housing, an actuator member pivotally mounted on said release pushbutton for causing one of said latching members to latch the corresponding switch pushbutton in its depressed position under the control of said spring-biased release pushbutton, and an auxiliary contact mounted in said housing for actuation by said release pushbutton, and (b) a transformer operated pilot light;

and means in said housing for interchangeably mounting either of said switch accessory means.

* * * * *

UNITED STATES PATENT AND TRADEMARK OFFICE

CERTIFICATE OF CORRECTION

PATENT NO. : 4,544,810
DATED : October 1, 1985
INVENTOR(S) : Edmund M. Butterworth It is certified that error appears in the above-identified patent and that said Letters Patent are hereby corrected as shown below:

Column 1, line 16, after "is" add -- actuated --;
line 18, after "simultaneous" add -- depression --;
line 34, after "of" second occurrence add -- the --;
line 35, after "spring" add -- -biased --.

Column 3, line 18, after "base," add -- upward movement --;
line 19, after "2c" add -- downward movement stop 2b' --.

Signed and Sealed this

*Seventeenth* Day of *December 1985*

[SEAL]

*Attest:*

DONALD J. QUIGG

*Attesting Officer*

*Commissioner of Patents and Trademarks*